US007950179B2

(12) United States Patent
Confrey

(10) Patent No.: US 7,950,179 B2
(45) Date of Patent: May 31, 2011

(54) ATTACHABLE HANDGUN STORAGE ACCESSORY

(75) Inventor: William J. Confrey, Pearl River, NY (US)

(73) Assignee: Lightsword, Inc., Pearl River, NY (US)

( * ) Notice: Subject to any disclaimer, the term of this patent is extended or adjusted under 35 U.S.C. 154(b) by 189 days.

(21) Appl. No.: 12/466,913

(22) Filed: May 15, 2009

(65) Prior Publication Data

US 2009/0282721 A1 Nov. 19, 2009

Related U.S. Application Data

(60) Provisional application No. 61/127,730, filed on May 15, 2008.

(51) Int. Cl.
*F41A 9/61* (2006.01)
*F41A 35/00* (2006.01)

(52) U.S. Cl. ..... 42/90; 42/49.01; 42/49.02

(58) Field of Classification Search ..... 42/49.01, 42/49.02, 50, 90, 7, 85
See application file for complete search history.

(56) References Cited

U.S. PATENT DOCUMENTS 2,715,789 A 8/1955 Garand
4,447,976 A * 5/1984 Cooper ..... 42/49.02
4,495,720 A 1/1985 Bross
4,592,160 A 6/1986 Bross
5,048,215 A * 9/1991 Davis ..... 42/72
D344,780 S * 3/1994 Jenkins ..... D22/108
5,461,811 A 10/1995 Ciener
5,557,872 A * 9/1996 Langner ..... 42/117
5,651,204 A * 7/1997 Hulsey et al. ..... 42/50
5,666,752 A 9/1997 Grams
5,906,065 A 5/1999 Pearce
6,536,152 B1 * 3/2003 Wisz ..... 42/71.01
6,557,287 B2 * 5/2003 Wollmann ..... 42/50
6,640,480 B2 * 11/2003 Williams et al. ..... 42/95
6,698,127 B2 * 3/2004 Weber ..... 42/71.02
7,093,386 B1 8/2006 Vieweg
7,117,622 B2 * 10/2006 Freed et al. ..... 42/7
7,257,919 B1 * 8/2007 Farley ..... 42/87
7,509,767 B2 * 3/2009 Bolen ..... 42/50
7,699,047 B2 * 4/2010 Tippman et al. ..... 124/73

* cited by examiner

*Primary Examiner* — Michael Carone
*Assistant Examiner* — Joshua Freeman
(74) *Attorney, Agent, or Firm* — IM IP Law PLLC; C. Andrew Im

(57) ABSTRACT

An attachable storage receptacle for storing an accessory on a firearm comprises a storage receptacle body having a top portion, a bottom portion and a wall portion, and an attaching mechanism on the top portion of the storage receptacle body for releasably attaching the storage receptacle body to a bottom end of a firearm magazine. The wall portion is connected to the top portion at one end and the bottom portion at the other end, thereby forming a hollow inner portion for storing the accessory in the storage receptacle.

13 Claims, 6 Drawing Sheets

ATTACHABLE HANDGUN STORAGE ACCESSORY

RELATED APPLICATION

This application claims priority to U.S. Provisional Patent Application No. 61/127,730, filed on May 15, 2008, which is incorporated herein by reference in its entirety.

FIELD OF THE INVENTION

The claimed invention relates to gun accessories that connect to cartridge magazines commonly used in semi-automatic firearms or handguns. More particularly, this invention relates to innovative systems for carrying accessories on the firearm itself.

BACKGROUND OF THE INVENTION

Security personnel such as soldiers, police officers, and security guards need to act swiftly when subduing hostile individuals. Rapidly retaining control over a hostile individual is critical to the safety of the surrounding public and the security personnel themselves. Any delay in restraining a hostile individual can result in grave consequences, including serious physical injury and sometimes even death. Typically, security personnel will use firearms and restraining instruments, such as handcuffs or flexcuffs, to hastily subdue and restrain hostile individuals until further measures can be taken.

While firearms are typically worn on a person, restraining instruments generally are placed in a separate location either attached to the person's clothing or placed in an accompanying bag, vehicle, or some other nearby location. Because the restraining instrument is stored separately, when hostile individuals are accosted or even subdued, the security personnel must subsequently retrieve the restraining instrument from the separate location where it was stored. This retrieval inevitably delays the arrest of the hostile individual. In a worst case scenario, the security personnel may even forgot or misplace the restraining instrument or simply does not bring the instrument—as may be the case when personnel are off-duty. Naturally, these circumstances create serious complications when subduing and restraining hostile, aggressive, and belligerent individuals.

As such, there remains a need for an improved system for retrieving a restraining instrument that is quick, convenient, and that minimizes the risk of forgetting or misplacing the restraining instrument, thereby facilitating an expeditious arrest.

SUMMARY AND OBJECTS OF THE INVENTION

The claimed invention is directed to a firearm or handgun storage accessory or compartment that is attached to the bottom of the gun's cartridge magazine, thereby allowing the owner to easily carry a restraining instrument that fits into the compartment, including but not limited to flexcuffs. As such, the innovative storage compartment allows for the gun and restraining instrument to be transported as an integral unit, thereby facilitating quick access to the restraining instrument and also minimizing the risk of loss or misplacement of the restraining instrument. Of course, it will be understood by those of skill in the art that the storage compartment can carry any item of a person's choice that fits within the compartment including but not limited to keys, medication, jewelry, money, and the like. Moreover, the storage compartment functions also as a grip extender.

In accordance with an exemplary embodiment of the claimed invention, the inventive attachable storage receptacle for storing an accessory on a firearm comprises a storage receptacle body having a top portion, a bottom portion and a wall portion, and an attaching mechanism on the top portion of the storage receptacle body for releasably attaching the storage receptacle body to a bottom end of a firearm magazine. The wall portion is connected to the top portion at one end and the bottom portion at the other end, thereby forming a hollow inner portion for storing the accessory in the storage receptacle.

In accordance with another embodiment of the claimed invention, the attaching mechanism on the top portion of the storage receptacle body is operable to attach to a floor plate of the firearm magazine. In another embodiment the attaching mechanism is on a periphery of the top portion of the storage receptacle body and can be one of the following: a hinge, longitudinal grooves, mating flanges, a détente mechanism, or a snap.

In yet a further embodiment of the claimed invention, the top portion of the storage receptacle body is open, thereby allowing access to the accessory stored in the storage receptacle from the top by sliding off the storage receptacle body from the floor plate of the firearm magazine.

In another embodiment of the claimed invention, the bottom portion of the storage receptacle body comprises a cover for accessing the accessory stored in the storage receptacle without sliding or moving the storage receptacle body from the firearm magazine. In a further embodiment of the claimed invention, the cover comprises an attachment mechanism to access the accessory stored in the storage receptacle without completely detaching the bottom cover from the storage receptacle body.

In yet another embodiment of the claimed invention, the wall portion of the storage receptacle body comprises a cover for accessing the accessory stored in the storage receptacle without sliding or moving the storage receptacle body from the firearm magazine, and the cover comprises an attachment mechanism to access the accessory stored in the storage receptacle without completely detaching the cover from the storage receptacle body. In a further embodiment of the claimed invention, the wall portion of the storage receptacle body has a convexly curved front portion to provide a finger grip surface. In another embodiment of the claimed invention, the storage receptacle body is formed from a high impact non-metallic plastic material, metal or galvanized rubber. In yet another embodiment of the claimed invention, the storage receptacle body is formed as a single injection molded piece.

In an alternate embodiment of the claimed invention, the attachable storage receptacle further comprises an adapter for releasably attaching to the top portion of the storage receptacle body and the bottom end of the firearm magazine. In yet a further embodiment, the adapter is operable to replace a floor plate of the firearm magazine. ***

In yet another embodiment of the claimed invention, the top portion of the storage receptacle body is closed to provide an enclosed storage receptacle body and operable to replace a floor plate of the firearm magazine. In a further embodiment, the bottom portion of the storage receptacle body comprises a cover for accessing the accessory stored in the storage receptacle without sliding or moving the storage receptacle body from the firearm magazine. In another embodiment, the cover comprises an attachment mechanism to access the accessory stored in the storage receptacle without completely detaching the bottom cover from the storage receptacle body.

In yet a further embodiment of the attachable storage receptacle, the wall portion of the storage receptacle body comprises a cover for accessing the accessory stored in the storage receptacle without sliding or moving the storage receptacle body from the firearm magazine. In an additional embodiment of the claimed invention, the cover comprises an attachment mechanism to access the accessory stored in the storage receptacle without completely detaching the cover from the storage receptacle body.

In yet another embodiment of the claimed invention, the attachable storage receptacle further comprises a connector disposed within the hollow inner portion of the storage receptacle body for securing the accessory within said storage receptacle.

Various other objects, advantages and features of the claimed invention will become readily apparent from the ensuing detailed description and the novel features will be particularly pointed out in the appended claims.

DESCRIPTION OF THE DRAWINGS

Embodiments of the claimed invention will be described with reference to the attached drawings in which like components or features in the various Figures are represented by like reference numbers.

DETAILED DESCRIPTION OF THE INVENTION

The claimed invention is directed to a firearm or handgun storage accessory or compartment that is removably attached to the bottom of the gun's cartridge magazine, thereby allowing the owner to easily carry a restraining instrument that fits into the compartment, including but not limited to flexcuffs. As such, the innovative storage compartment allows for the gun and restraining instrument to be transported as an integral unit, thereby facilitating quick access to the restraining instrument and also minimizing the risk of loss or misplacement of the restraining instrument. Of course, it will be understood by those of skill in the art that the storage compartment can carry any item of a person's choice that fits within the compartment, such as flexcuffs, keys, medication and the like.

With reference to the Figures, exemplary embodiments of the claimed invention are now described in greater detail. Although the description includes exemplary embodiments, it can be easily seen that other embodiments are possible, and changes can be made to the embodiments described without departing from the spirit of the disclosed apparatus.

Figure 1:
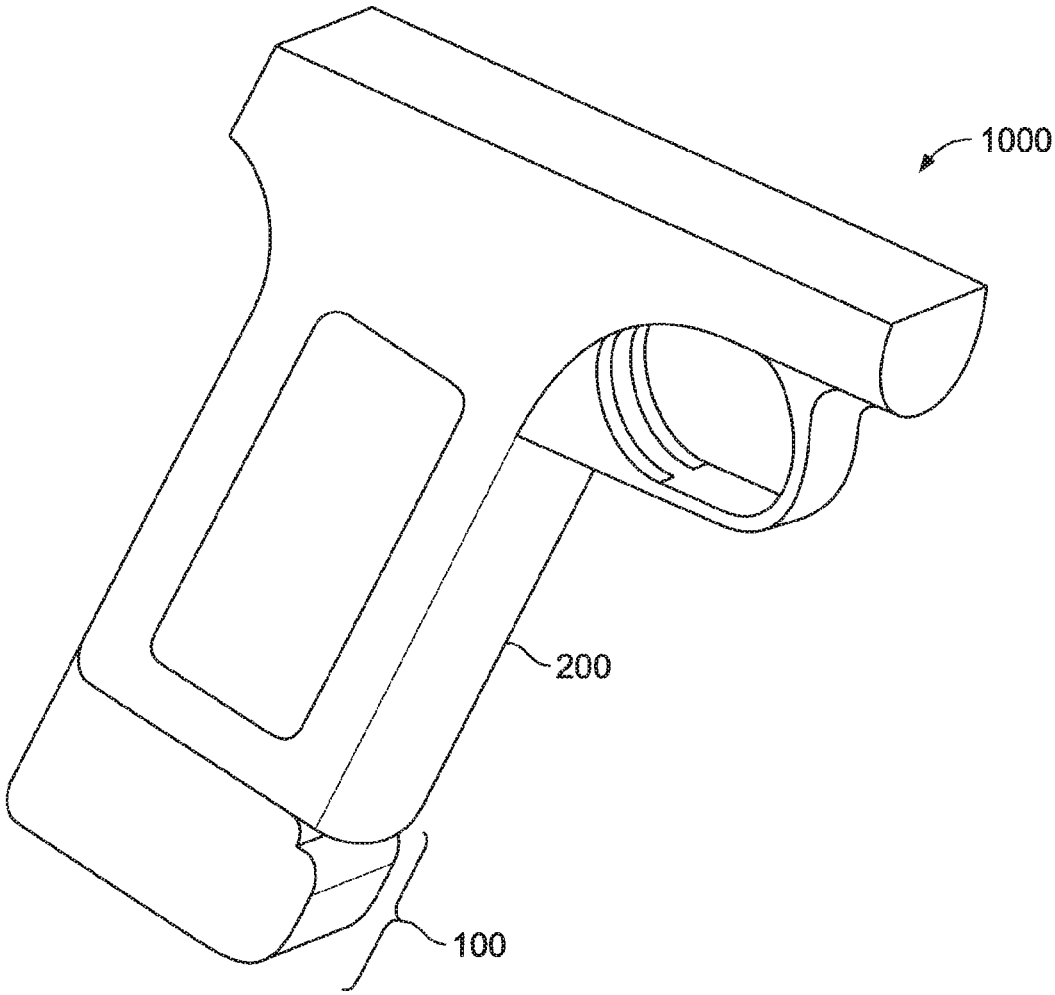
FIG. 1 is a perspective view of an exemplary embodiment of the inventive storage receptacle attached to a firearm magazine, where the storage receptacle is opened from the bottom.
Figure 2A:
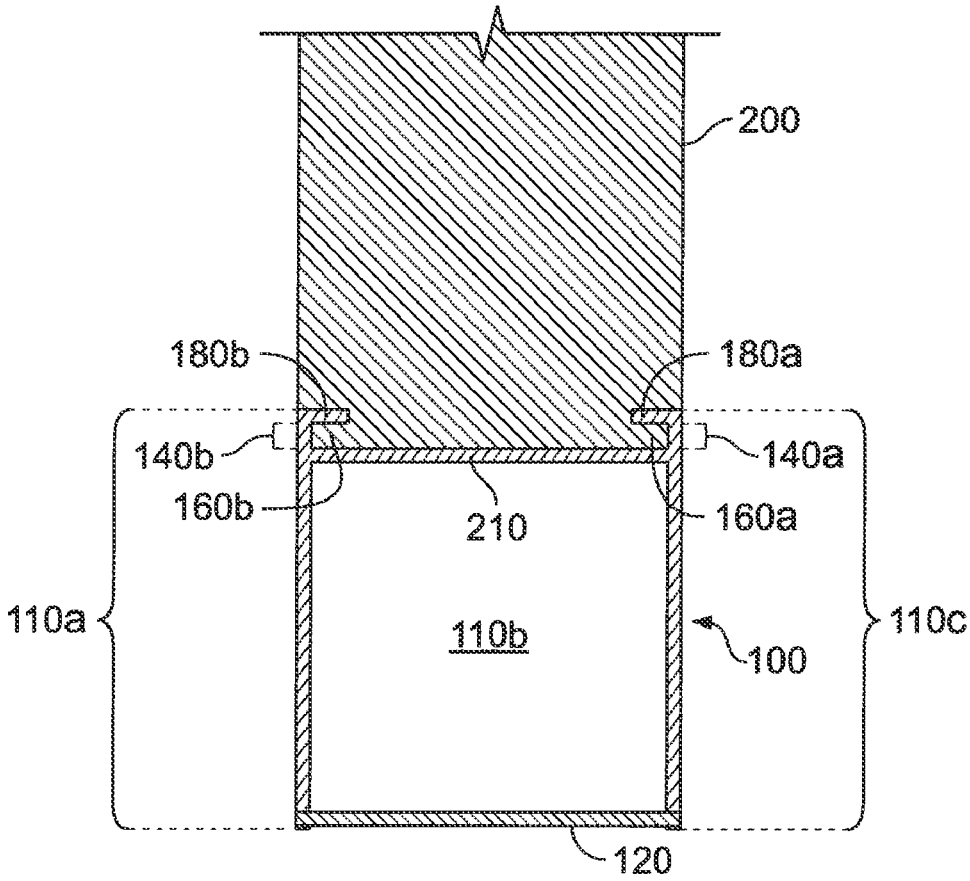
FIG. 2*a* is a front cross-sectional view of an exemplary embodiment of the inventive storage receptacle of FIG. 1 attached to a firearm.

FIG. 1 shows an exemplary embodiment of the innovative firearm accessory storage receptacle 100 for use with a firearm 1000 which is attached to the bottom of a firearm magazine 200. FIG. 2*a* shows a front cross-sectional view of an exemplary embodiment of the inventive storage receptacle 100 where the storage receptacle 100 is opened from the bottom side. As shown in greater detail in FIGS. 2*a* and 2*b*, in accordance with an exemplary embodiment, the storage receptacle 100 comprises a top portion 210 and storage receptacle wall pieces 110*a*-110*d* that extend downward from the top portion 210 to form a hollow enclosure where an accessory can be stored. In order to releasably close the hollow enclosure and therefore contain the accessory therein, storage receptacle 100 further comprises a bottom cover 120. The storage receptacle 100 can house an item such as flexcuffs and is releasably connected to the bottom of firearm magazine 200, such that a user can easily retrieve the flexcuffs or other stored item by disengaging a releasable connecting mechanism on the bottom of the storage receptacle 100. In an exemplary embodiment, top portion 210 and storage receptacle wall pieces 110*a*-110*d* can be formed as a single injection molded piece and can be made from a high impact non-metallic plastic material. Other materials and methods of manufacture are, of course, within the scope of the claimed invention, such as metal, galvanized rubber, and the like.

Figure 2B:
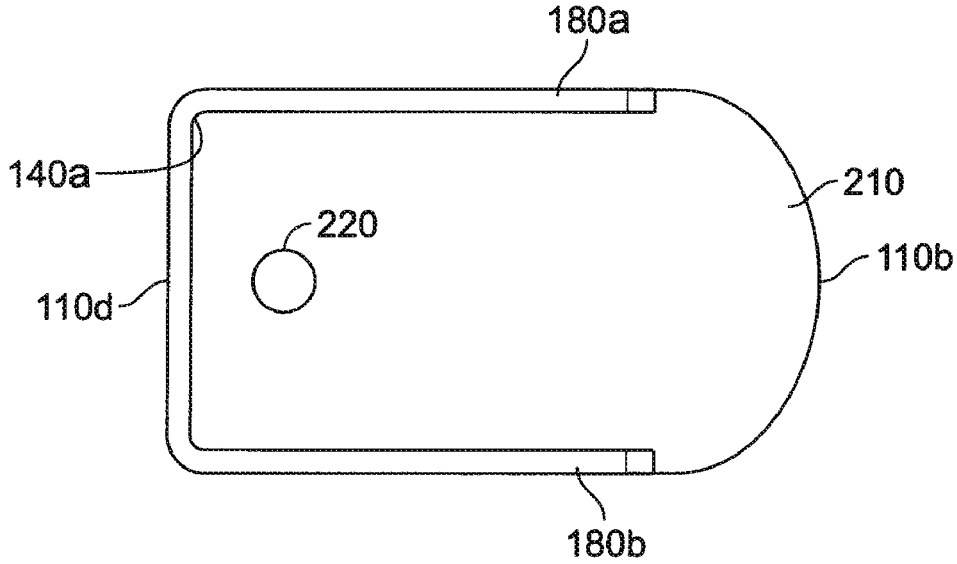
FIG. 2*b* is a top view of an exemplary embodiment of the inventive storage receptacle shown in FIG. 1.
Figure 2C:
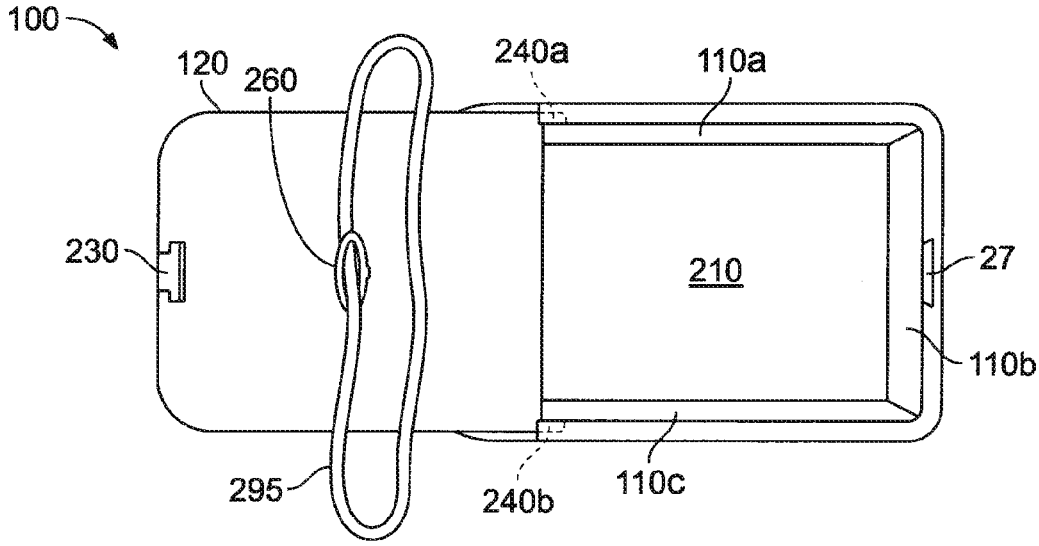
FIG. 2*c* is a bottom view of an exemplary embodiment of the inventive storage receptacle shown in FIG. 1, where the storage receptacle is open.

FIG. 2*a* is a front perspective view of the exemplary embodiment of the inventive storage receptacle where the storage receptacle 100 is opened from the bottom. Of course, it will be understood by one of ordinary skill in the art that the storage receptacle 100 can be opened from any of its sides as well. FIG. 2*b* is a top portion of the exemplary embodiment of the inventive storage receptacle 100 shown in FIG. 1. FIG. 2*c* is a bottom view of the exemplary embodiment of the inventive storage receptacle 100 shown in FIG. 1, where the storage receptacle is open. As shown in FIGS. 2*a*, 2*b*, 2*c*, storage receptacle 100 comprises a hollow compartment formed from an opening at the bottom and a top portion 210 connected by adjoining walls 110*a*-110*d*. The storage receptacle 100 is generally rectangular with a back wall 110*d* and a front wall 110*b*. The right and left side walls 110*a* and 110*c*, are straight and extend between the front wall 110*b* and the back wall 110*d*. The top portion 210 is adjoined to the walls 110*a*-110*d* and seals the top of the storage receptacle 100, forming the roof of storage receptacle 100. As shown with respect to FIGS. 2*a* and 2*b*, the perimeter of the top portion 210 of storage receptacle 100 comprises longtitudinal grooves 140*a* and 140*b* for releasably engaging with a set of mating flanges 160*a* and 160*b* on the bottom of a magazine 200 in a sliding fashion. In an exemplary embodiment of the claimed invention, top portion 210 serve as the floor plate of magazine 200, comprising an indentation 220 for engaging with the magazine spring or coil mechanism of the firearm magazine 200. In an alternate embodiment, the top portion 210 of storage receptacle 100 can comprise the mating flanges 160*a* and 160*b* and the magazine 200 can comprise the longitudinal grooves 140*a* and 140*b* that releasably engage the mating flanges 160*a* and 160*b* on the storage receptacle 100. The user can thereby slide storage receptacle 100 off and on of magazine 200, to attach the storage receptacle 100 to the firearm 1000. Other methods of connecting storage receptacle 100 to magazine 200 are, of course, within the scope of the claimed invention, and include but are not limited to by quick/connect mechanisms, détente mechanisms, and mechanisms that are used to connect grip extenders to firearms. Moreover, the shape of the storage receptacle can be curved or notched to fit various types, sizes, or models of firearm magazines and can doubly function as a grip extender. Furthermore, the shape of the front wall 110*b* of the storage receptacle can be convexly curved to provide a smooth indented surface for closer contact by the little finger of the hand gripping the firearm 200.

Of course, it will be well understood that in alternate embodiments, the inventive storage receptacle 100 can also be connected to magazine 200 via a third connecting piece, including but not limited to a separate modified firearm magazine cartridge floorplate, grip extender, or the like that include connecting mechanisms, such as but not limited to mating flanges and longtitudinal grooves, quick connect mechanisms and détente mechanisms, on their respective bottom surfaces to connect the top portion 210 of the storage receptacle 100. In one exemplary embodiment, a separate floorplate piece can be used to connect the storage receptacle 100 to the magazine 200. The storage receptacle 100 can also be connected to the bottom of the floorplate by any contemplated connecting mechanism including but not limited to mating flanges and grooves as described above, a hinge, or détente mechanism.

In an exemplary embodiment, as shown in FIG. 2*c*, bottom cover 120 comprises an attachment mechanism such as hinges 240*a* and 240*b* at one end for connecting to the lower end of corresponding back wall 110*d* of storage receptacle 100. This allows for the bottom cover 120 to be opened without needing to completely detach the bottom cover 120 from the rest of the storage receptacle 100. Bottom cover 120 further comprises a locking piece 230, such as but not limited to a snap, clasp, détente mechanism, or hook, for connecting to a locking piece receiving structure 27 disposed on the lower end of corresponding front wall 110*b*. In order to retrieve the stored accessory, the user can merely disengage the locking piece 230 from the locking piece receiving structure 27 and swing the bottom cover 120 open like a door by way of the hinges 240*a* and 240*b*. It will be understood by one of ordinary skill in the art that in alternate embodiments of the claimed invention, the bottom cover 120 can not only be attached at one end to the storage receptacle body but instead can slide on and off or snap on and off as an entirely separate piece. Of course, it will be well understood by those of skill in the art, that bottom cover 120 can be connected to the main body of the storage receptacle 100 by any releasable connecting mechanism including but not limited to: mating longitudinal grooves and flanges, a détente, a snap, a clasp, a hook, or the like. Lastly, in an alternate embodiment only a portion of the bottom cover 120 is removable.

Figure 2D:
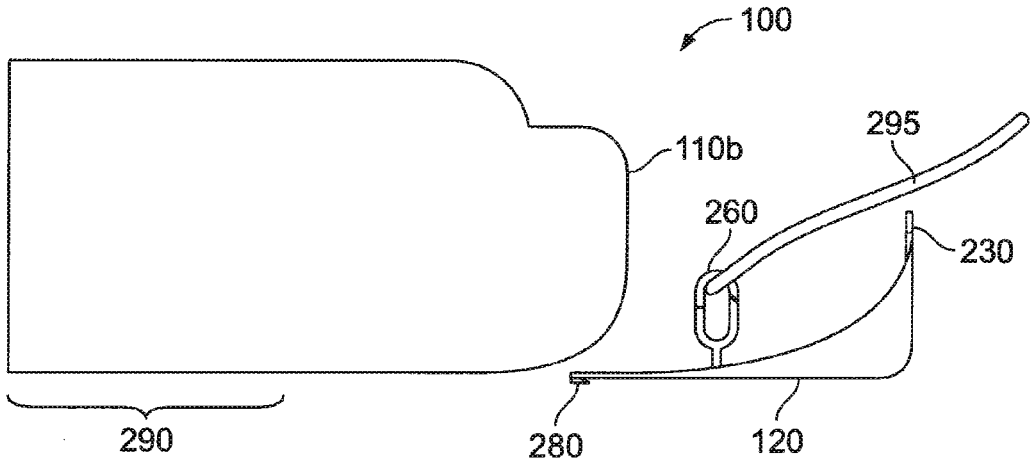
FIG. 2*d* is a side view of an exemplary embodiment of the inventive storage receptacle comprising a removable bottom cover that comprises only a portion of the bottom piece of the storage receptacle, and that comprises a holding mechanism for securing the accessory within the storage receptacle.

As shown in FIG. 2*c*, in accordance with an exemplary embodiment of the claimed invention, there can be a holding mechanism 260 for securing the accessory such as flexcuffs 295 and the like within the storage receptacle 100. Thus, when the storage receptacle 100 is opened, the flexcuffs 295 do not drop but instead are readily accessible, needing only to be pulled or otherwise easily released from the holding mechanism 260. An exemplary embodiment of a holding mechanism 260 of the claimed invention is shown in FIGS. 2*c* and 2*d*. The holding mechanism 260, such as but not limited to a clasp, a snap, a strap, a hook, a string, a sticker, a tack, and the like, is displaced in the center inner surface of bottom cover 120. Flexcuffs 295 are securely and releasably restrained by the holding mechanism 260. When a user opens the bottom cover 120, the flexcuffs 295 are readily available and the user can simply pull the flexcuffs 295 to disengage them from the holding mechanism 260.

As shown in FIG. 2*d*, in accordance with an exemplary embodiment of the claimed invention, storage receptacle 100 comprises a bottom wall 290 permanently attached to the bottoms of side walls 110*a*, 110*c* and 110*d* and extending across the opening to form only a partial floor of storage receptacle 100, leaving an opening only at the bottom front part of the storage receptacle 100. Bottom cover 120 then is releasably attached to the front of bottom wall 290 by hook 280 and attached to the front wall 110*b* of storage receptacle 100 by a locking piece 230, such as but not limited to a clasp, a snap, a hook, or the like. Bottom cover 120 can further comprise a holding mechanism 260, such as but not limited to a clasp, a snap, a strap, a hook, a string, a sticker, a tack, and the like, for securing an accessory such as flexcuffs 295 and the like. Thus, a user can quickly separate the bottom cover 120 and have the flexcuffs 295 already removed from the storage receptacle 100 by way of the holding mechanism 260 on the separate bottom cover 120. When the user separates the bottom cover 120 from the storage receptacle 100, he or she also pulls out the flexcuffs 295 instead of separately having to retrieve the flexcuffs 295 from the storage receptacle 100. Of course, it will be understood by those of skill in the art that in other exemplary embodiments of the claimed invention, bottom cover 120 can be attached to bottom wall 290 by any releasable connecting mechanism including but not limited to by a quick-connect mechanism.

Figure 3:
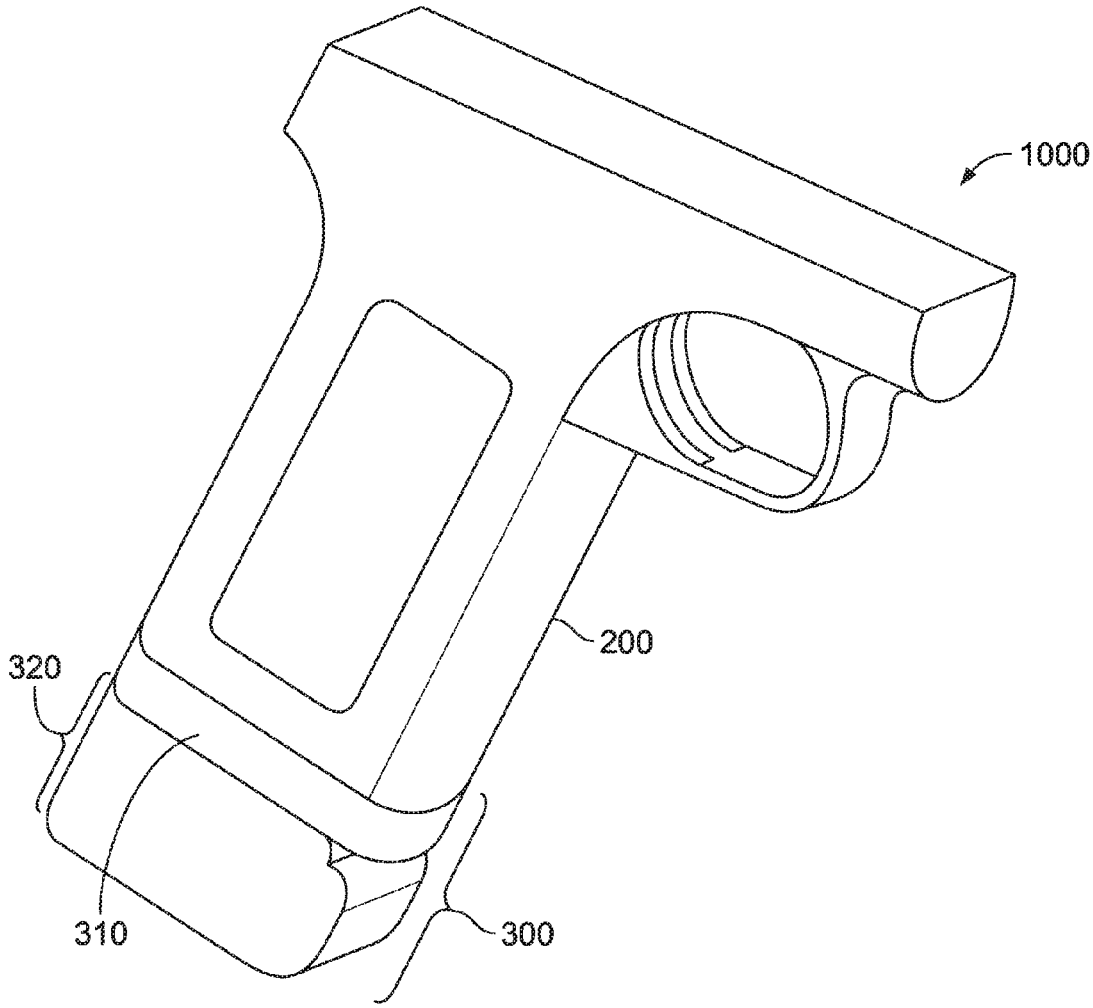
FIG. 3 is a perspective view of an exemplary embodiment of the inventive storage receptacle attached to a firearm, where the storage receptacle is accessed from the top.

In accordance with an exemplary embodiment of the claimed invention, the storage receptacle 100 is open from the top. FIG. 3 shows an exemplary embodiment of the innovative firearm accessory storage receptacle unit 300 attached to the bottom of the handgun magazine 200. The storage receptacle unit 300 comprises a storage receptacle 320 and a floorplate 310. The storage receptacle 320 can house an item such as flexcuffs and the like, and is releasably connected to floorplate 310, such that a user can easily retrieve the stored items, e.g., flexcuffs by disengaging a releasable connecting mechanism described in greater detail below.

Figure 4A:
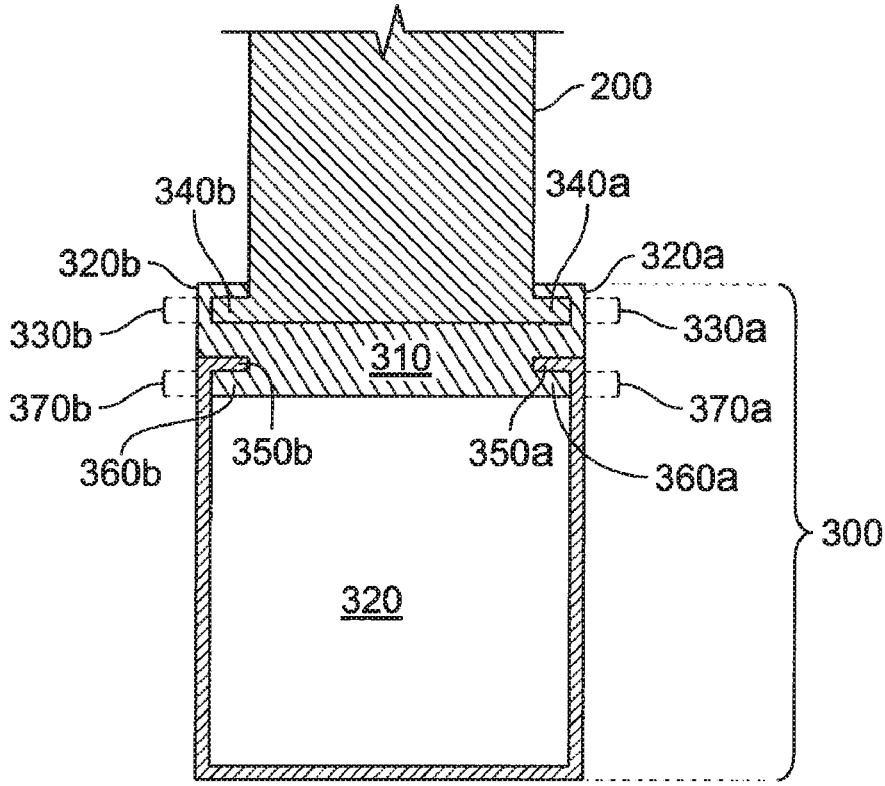
FIG. 4*a* is a front cross-sectional view of an exemplary embodiment of a storage receptacle unit attached to a firearm.
Figure 4B:
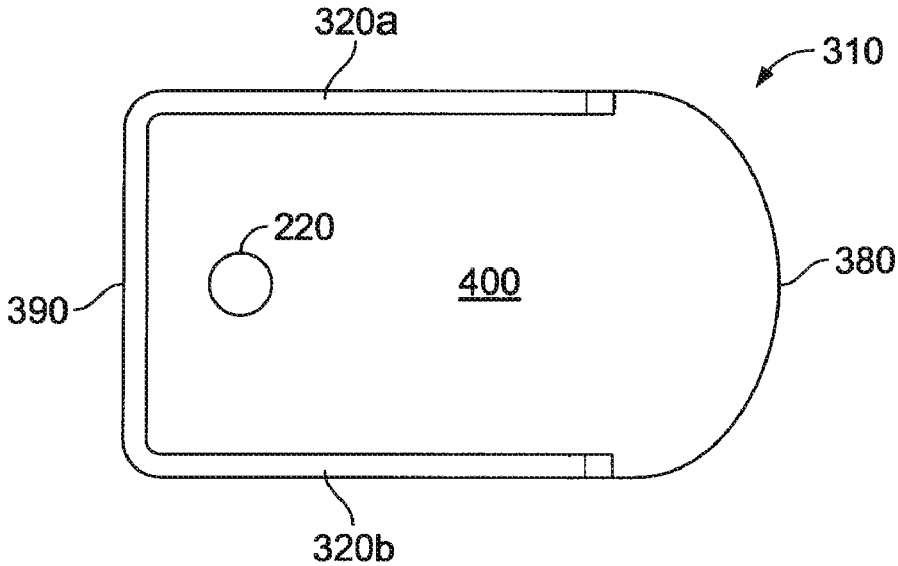
FIG. 4*b* is a top perspective view of an exemplary embodiment of the removable floorplate of an embodiment of the inventive storage receptacle.

FIG. 4*a* is a front cross-sectional view of an exemplary embodiment of a storage receptacle unit 300 attached to a firearm 1000 that includes a cross-section of a removable floorplate 310. FIG. 4*b* is a top perspective view of a removable floorplate 310, in accordance with an exemplary embodiment of the claimed invention. The floorplate 310 can be formed as a single injection molded piece and can be made from a high impact non-metallic plastic material, metal, galvanize rubber and the like. Other materials and methods of manufacture are, of course, within the scope of the claimed invention. The floorplate 310 comprises a flat body having a generally planar top portion 400. The body is generally rectangular with a straight back wall 390 and a curved front wall 380. The right and left side walls 320*a* and 320*b*, are substantially straight and extend between the curved front wall 380 and the straight back wall 390. As seen in FIG. 4*a*, the side walls 320*b* and 320*a* can be provided with narrow longitudinal grooves 330*a* and 330*b* designed to receive mating side flanges 340*a* and 340*b* on the magazine 200. Other methods of connecting floorplate 310 to magazine 200 are, of course, within the scope of the claimed invention. Also, as shown in FIG. 4*a*, the bottom portion of floorplate 310 can comprise mating flanges 360*a* and 360*b* for releasably engaging with narrow longitudinal grooves 370*a* and 370*b* on the storage receptacle 320 in a manner well understood by those of ordinary skill in the art. Other methods of releasably connecting floorplate 310 to storage receptacle 320 are, of course, within the scope of the claimed invention.

Figure 4C:
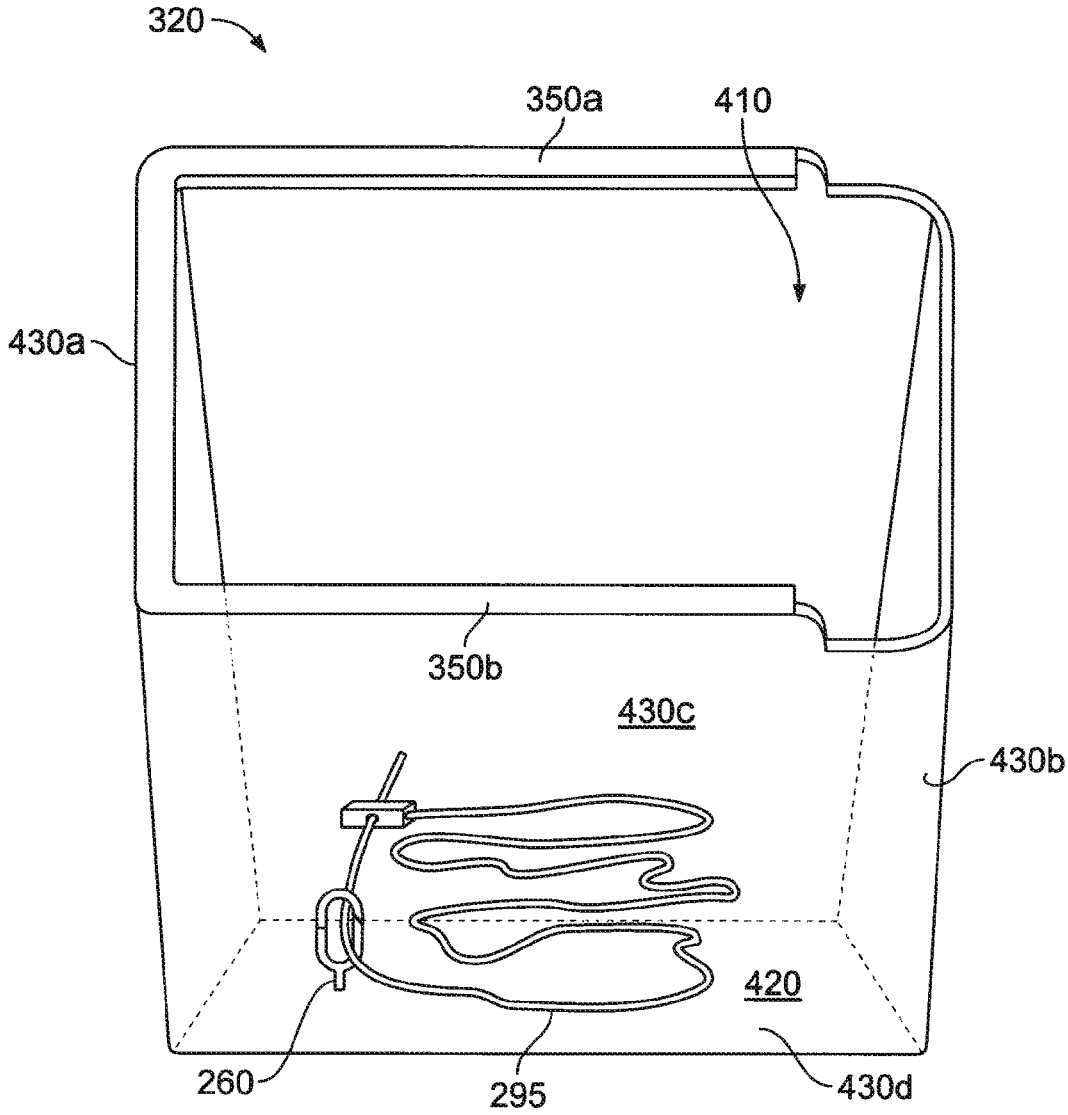
FIG. 4*c* is a perspective top view of an exemplary embodiment of the storage receptacle shown in FIG. 3, that is open at the top.

FIG. 4*c* shows an exemplary embodiment of storage receptacle 320 without the floorplate 310. The storage receptacle 320 can be formed as a single injection molded piece and can be made from a high impact non-metallic plastic material, metal, galvanized rubber and the like. Other materials and methods of manufacture are, of course, within the scope of the claimed invention. The storage receptacle 320 comprises a hollow compartment 410 having an open top and a bottom floor 420 connected by adjoining walls 430*a*-430*d*, thereby creating the hollow compartment 410. The storage receptacle 320 is generally rectangular with a back wall 430*a* and a front wall 430*b*. The right and left side walls 430*c* and 430*d*, are straight and extend between the front wall 430*b* and the back wall 430*d*. The bottom floor 420 is adjoined to said walls and seals the bottom of the storage receptacle 320, thereby creating the floor of the hollow compartment 410. As seen in FIGS. 4*a*-*c*, the perimeter of the open top of storage receptacle 320 comprises mating flanges 350*a* and 350*b* for releasably engaging with narrow longitudinal grooves 370*a* and 370*b* on the bottom surface of floorplate 310. Alternatively, the bottom surface of floorplate 310 can comprise the longitudinal grooves 370*a* and 370*b*, and the storage receptacle 320 can comprise the mating flanges 350*b* and 350*a* designed to releasably engage the longitudinal grooves 370*a* and 370*b*. Other methods of releasably connecting floorplate 310 to storage receptacle 320 and magazine 200 are, of course, within the scope of the claimed invention, including but not limited to a hinge, a détente mechanism or a quick-connect mechanism. The user can thereby slide storage receptacle 320 off of floorplate 310, to reveal the compartment and thereby retrieve or store the item(s) within, such as flexcuffs, keys, and the like. Alternatively, the inventive storage receptacle can comprise bottom or side covers, thereby enabling the user to retrieve the stored items without sliding the receptacle on and off floorplate 310.

In accordance with an exemplary embodiment of the claimed invention, a mechanism 260 for holding the flexcuffs resides within the storage receptacle 320 or is attached to the bottom of the floorplate 310. FIG. 4*c* further shows a holding means, as a clasp displaced in the center inner surface of the bottom of storage receptacle 320. Thus, when the storage receptacle is removed, the stored items, such as flexcuffs, do not fall out but instead are readily accessible, needing only to be released from the holding mechanism 260. Such holding mechanisms 260 include but are not limited to a clasp, a strap, a hook, a string, a sticker, a tack, and the like. In FIG. 4*c*, holding mechanism 260 is a clasp displaced in the center inner surface of the bottom of storage receptacle 320. Flexcuffs 295 are securely and releasably restrained by the clasp. When a user disengages the storage receptacle bottom from the floorplate 310, the flex cuffs 295 are readily available. The user merely has to pull the flexcuffs 295 and they should become easily disengaged. Such holding mechanisms include but are not limited to a clasp, a snap, a strap, a hook, a string, a sticker, a tack, and the like.

The various embodiments of the claimed invention described herein, have many advantages, including but not limited to a much more convenient way of transporting and accessing a restraining instrument by law enforcement officers and security personnel. By allowing a user to store the restraining instrument on the gun, several advantages are realized including but not limited to an easy and quick retrieval of a restraining instrument and less chance that the user of the handgun will have forgotten or misplaced his or her flexcuffs. Although the claimed invention has been described in considerable detail with reference to certain embodiments thereof, other embodiments are possible. For example: the storage receptacle can be opened on any one of its sides; the storage receptacle can be opened and closed in a variety of ways including but not limited to the use of a hinge, a locking mechanism, a clasp, resealable glue, a détente mechanism, and the like; the inventive compartment can also serve as a grip extender. Furthermore, the storage receptacle can be designed to simply connect over an already existing magazine, for example, by sliding over an existing magazine in accordance with the description above. Lastly, it should be understood that the storage receptacle can be designed to fit any shape of magazine bottom. Any and all such embodiments and others as readily understood by those of skill in the art are contemplated by the claimed invention.

While the claimed invention has been particularly described with respect to the illustrated embodiment, it will be appreciated that various alterations, modifications and adaptations may be made based on the present disclosure, and are intended to be within the scope of the claimed invention. Therefore, the spirit and scope of the appended claims should not be limited to the description of the embodiments herein.

What is claimed:

1. An attachable storage receptacle for storing an accessory on a firearm comprising: a storage receptacle body having a top portion, a bottom portion and a wall portion; and an attaching mechanism on said top portion of said storage receptacle body for releasably attaching said storage receptacle body to a bottom end of a firearm magazine; wherein said wall portion is connected to said top portion at one end and said bottom portion at the other end, thereby forming a hollow inner portion for storing said accessory in said storage receptacle, and wherein said top portion of said storage receptacle body seals top of said storage receptacle to provide an enclosed storage receptacle; and wherein said bottom portion and wall portion of said storage receptacle body comprises a moveable cover for accessing said accessory stored in said storage receptacle without sliding or moving said storage receptacle body from said firearm magazine.

2. The attachable storage receptacle of claim 1, wherein said attaching mechanism on said top portion of said storage receptacle body is operable to attach to a floor plate of said firearm magazine.

3. The attachable storage receptacle of claim 1, wherein said attaching mechanism is on a periphery of said top portion of said storage receptacle body.

4. The attachable storage receptacle of claim 1, wherein said attaching mechanism on said top portion of said storage receptacle body is one of the following: a hinge, longitudinal grooves, mating flanges, a détente mechanism, or a snap.

5. The attachable storage receptacle of claim 1, wherein said moveable cover comprises an attachment mechanism to access said accessory stored in said storage receptacle without completely detaching said moveable cover from said storage receptacle body.

6. The attachable storage receptacle of claim 1, wherein said moveable cover comprises an attachment mechanism to access said accessory stored in said storage receptacle without completely detaching said moveable cover from said storage receptacle body.

7. The attachable storage receptacle of claim 1, wherein said wall portion of said storage receptacle body has a convexly curved front portion to provide a finger grip surface.

8. The attachable storage receptacle of claim 1, wherein said storage receptacle body is formed from a high impact non-metallic plastic material, metal or galvanized rubber.

9. The attachable storage receptacle of claim 1, wherein said storage receptacle body is formed as a single injection molded piece.

10. The attachable storage receptacle of claim 1, further comprising an adapter for releasably attaching to said top portion of said storage receptacle body and said bottom end of said firearm magazine.

11. The attachable storage receptacle of claim 10, wherein said adapter is operable to replace a floor plate of said firearm magazine.

12. The attachable storage receptacle of claim 1, wherein said top portion of said storage receptacle body is operable to replace a floor plate of said firearm magazine.

13. The attachable storage receptacle of claim 1, further comprising a connector disposed within the hollow inner portion of said storage receptacle body for securing said accessory within said storage receptacle.

* * * * *